US008020350B2

(12) United States Patent
Lundsgaard et al.

(10) Patent No.: US 8,020,350 B2
(45) Date of Patent: Sep. 20, 2011

(54) SEAMLESS DECK-SEALING SURROUND FOR SKYLIGHTS AND ROOF WINDOWS

(75) Inventors: Christian Aage Lundsgaard, Ry (DK); Jeffery Joseph Ronan, Greenwood, SC (US); Wylie Wayne Quarles, Greenwood, SC (US); Charles Joseph Rimsky, Greenwood, SC (US); James Eric Brinton, Greenwood, SC (US); Michael James Waters, Greenwood, SC (US); Brent Moeller, Gentofte (DK)

(73) Assignee: VKR Holding A/S (DK)

( * ) Notice: Subject to any disclaimer, the term of this patent is extended or adjusted under 35 U.S.C. 154(b) by 162 days.

(21) Appl. No.: 12/176,513

(22) Filed: Jul. 21, 2008

(65) Prior Publication Data

US 2010/0011682 A1 Jan. 21, 2010

(51) Int. Cl.
*E06B 1/06* (2006.01)
*E06B 3/00* (2006.01)
*E06B 7/00* (2006.01)

(52) U.S. Cl. ..... 52/210; 52/200; 52/506.06; 52/204.55

(58) Field of Classification Search ..... 52/198–200, 52/210–213, 204.595, 204.6, 204.61, 506.03, 52/506.06, 73, 173.1, 204.5, 204.55, 173.3
See application file for complete search history.

(56) References Cited

U.S. PATENT DOCUMENTS

| | | | | |
|---|---|---|---|---|
| 3,461,625 | A * | 8/1969 | Sandow | 52/58 |
| 3,473,276 | A * | 10/1969 | Back et al. | 52/200 |
| 4,470,230 | A * | 9/1984 | Weisner | 52/200 |
| 4,473,979 | A | 10/1984 | Bruhm | |
| 4,776,141 | A | 10/1988 | Powell | |
| 4,823,525 | A * | 4/1989 | Roberts et al. | 52/200 |
| 5,018,333 | A | 5/1991 | Bruhm | |
| 5,297,371 | A * | 3/1994 | Borghetto | 52/308 |
| 5,299,396 | A | 4/1994 | Rap et al. | |
| 5,806,255 | A | 9/1998 | Verby et al. | |
| 6,052,956 | A | 4/2000 | Hoy et al. | |
| 6,202,373 | B1 * | 3/2001 | Lindgren | 52/200 |
| 6,640,508 | B2 * | 11/2003 | Lindgren et al. | 52/200 |
| 6,804,918 | B2 * | 10/2004 | Lindgren et al. | 52/72 |
| 2002/0095884 | A1 | 7/2002 | Lindgren et al. | |
| 2003/0014926 | A1 | 1/2003 | Champa et al. | |
| 2004/0093806 | A1 | 5/2004 | Mares | |

FOREIGN PATENT DOCUMENTS

| | | | |
|---|---|---|---|
| CH | 666715 AS | * | 8/1988 |
| DE | 4335545 A1 | | 4/1995 |

OTHER PUBLICATIONS

International Search Report for corresponding International Patent Application PCT/US 2009/051160.

* cited by examiner

*Primary Examiner* — Jeanette E. Chapman
(74) *Attorney, Agent, or Firm* — Turner-PadgetGraham&Laney, PA

(57) ABSTRACT

A seamless surround for a rectangular skylight assembly is provided. Each side of the rectangular surround is characterized as having an obtuse-angled profile having an angle of between greater than 90 degrees and about 100 degrees, the profile including a vertically extending surface and a downwardly sloping surface. The vertically extending surfaces abut curb members attached to the skylight assembly and include apertures therethrough for receipt of a joining element. The downwardly sloping surfaces abut a building rooftop and further include apertures therethrough for receipt of a joining element. The roof-abutting side of the downwardly sloping surfaces includes a barrier material attached thereto. The barrier material may be any suitable air and water barrier, such as a polyurethane foam or a thermoplastic elastomer. A method of installing a skylight having the seamless surround is also provided.

3 Claims, 3 Drawing Sheets

Detail A

SEAMLESS DECK-SEALING SURROUND FOR SKYLIGHTS AND ROOF WINDOWS

TECHNICAL FIELD

The present disclosure relates to the field of skylights and roof windows and, more particularly, to a deck-sealing surround for such architectural elements.

BACKGROUND

Skylights and roof windows have been incorporated into buildings for decades as a way of introducing daylight and/or fresh air into a building interior. A skylight, which may be fixed or opening, typically is installed within a rooftop that is inaccessible from the building's interior without the use of a ladder. Most skylights include an insulated glass lens or covering element, a wood frame, and protective cladding, and some may be mounted directly to the roof deck (those being referred to as "deck-mounted" skylights). Flashing (sometimes referred to as "step-flashing") or other protective materials may also be used to create a watertight barrier around the skylight opening.

A roof window is designed for installation in homes or buildings where the roof is generally within reach of the building occupant. For example, roof windows may be installed in homes having low roof lines or in attics being used as living space. The roof window may possess a similar construction to a skylight, and may include opening, or ventilating, capability.

Such deck-mounted skylights and roof windows (collectively referred to herein as "skylights") are installed around a pre-cut opening within a roof. As with any window, steps must be taken to ensure that rain, wind, and the like are prevented from entering the home through the skylight opening. Particularly in colder climates that are prone to snow, where thawing and refreezing are common, a potential exists for melted snow or other precipitation to seep into the building around the perimeter of the skylight. To minimize the likelihood of leakage, skylight manufacturers typically recommend that a felt paper or a barrier paper (such as Grace's Ice and Water Shield® barrier paper, manufactured by W.R. Grace and Company of Connecticut) be applied around the curb or wood frame of the skylight assembly. Such paper or barrier material may be used in addition to the metal step-flashing commonly used around the perimeter of the skylight.

Unfortunately, it has been found that the protective underlayment may be applied incorrectly or may be omitted entirely, thus increasing the likelihood of a problem with the skylight installation. Step-flashings provide some protection against water, air, and moisture leaks, but their effectiveness is dependent, at least in part, upon the skill of the installer.

Accordingly, it would be desirable for a skylight to be provided with an effective air and moisture barrier that is readily attachable to the skylight assembly and to the roof and whose presence minimizes the likelihood of problematic leaking of the skylight.

SUMMARY

Provided herein is a unitary surround for a skylight assembly, the surround being in the form of a seamless member that defines a rectangular perimeter around the skylight. Each side of the rectangular surround is characterized as having an obtuse-angled profile having an angle of between about 95 degrees and about 100 degrees, the obtuse-angled profile including a vertically extending surface and a downwardly sloping surface. Each vertically extending surface is configured to abut a curb member attached to the skylight assembly and includes plurality of apertures therethrough for receipt of a joining element for securing the vertically extending surface to the curb member. Each downwardly sloping surface is configured to be held in tension against a rooftop and further includes a plurality of apertures therethrough for receipt of a joining element to secure the downwardly sloping surface to the roof. The downwardly sloping surfaces of the obtuse profile include a layer of barrier material attached to the roof-abutting side thereof. The barrier material may be any suitable air and water barrier, such as a polyurethane foam or a thermoplastic elastomer. The joining elements may be at least one of a screw, a nail, and a staple.

According to another aspect, the unitary surround may include a pair of longitudinal sides and a pair of transverse sides, in which each of the longitudinal sides includes at least one slot-shaped aperture therethrough for temporary receipt of a fastener during installation of the skylight.

According to yet another aspect, the respective ends of the downwardly sloping surfaces may include an inwardly projecting notch useful for aligning the skylight over an opening in a building rooftop.

Also provided herein is a method for installing a leak-proof skylight assembly around an opening in a building roof, the method including the steps of:

(a) providing a skylight assembly having a lens and a curb, the curb being defined by a plurality of members arranged to form a rectangular base for the skylight about the opening in the roof;

(b) providing a seamless surround, as discussed above;

(c) attaching the seamless surround about the perimeter of the skylight assembly, such that each vertically extending surface abuts one of the curb members and is secured to the respective curb member by joining elements positioned through each of the plurality of apertures and such that the edge of each downwardly sloping surface extends beyond the skylight perimeter;

(d) positioning the skylight assembly having the attached seamless surround around the opening in the roof, such that at least the edge of each downwardly sloping surface abuts the roof; and (e) securing the skylight assembly to the roof in tension, by positioning a joining element through each of the plurality of apertures in the downwardly sloping surfaces, such that a majority of the downwardly sloping surface contacts the roof, and wherein a layer of foam material attached to the lower side of the downwardly sloping surface forms a watertight seal between the roof and the skylight.

The method may further comprise installing flashing over the unitary surround and installing one or more cladding components over the flashing.

A skylight or roof window having such a unitary deck-sealing surround is also provided herein.

DETAILED DESCRIPTION

Reference is now made to the drawings for illustration of the various components of the present deck-sealing surround. A skylight is adapted to span an opening that is generally of square or rectangular shape. Accordingly, the present deck-sealing surround is similarly shaped and is sized to extend around the exterior perimeter of the skylight. Although the skylight assembly is shown and described as having a substantially flat construction employing flat glass panes, a domed-type skylight covering may instead be employed. Further, while reference is made throughout the disclosure to a skylight assembly, the present deck-sealing surround may be equally well-suited for use around a roof window.

Figure 1:
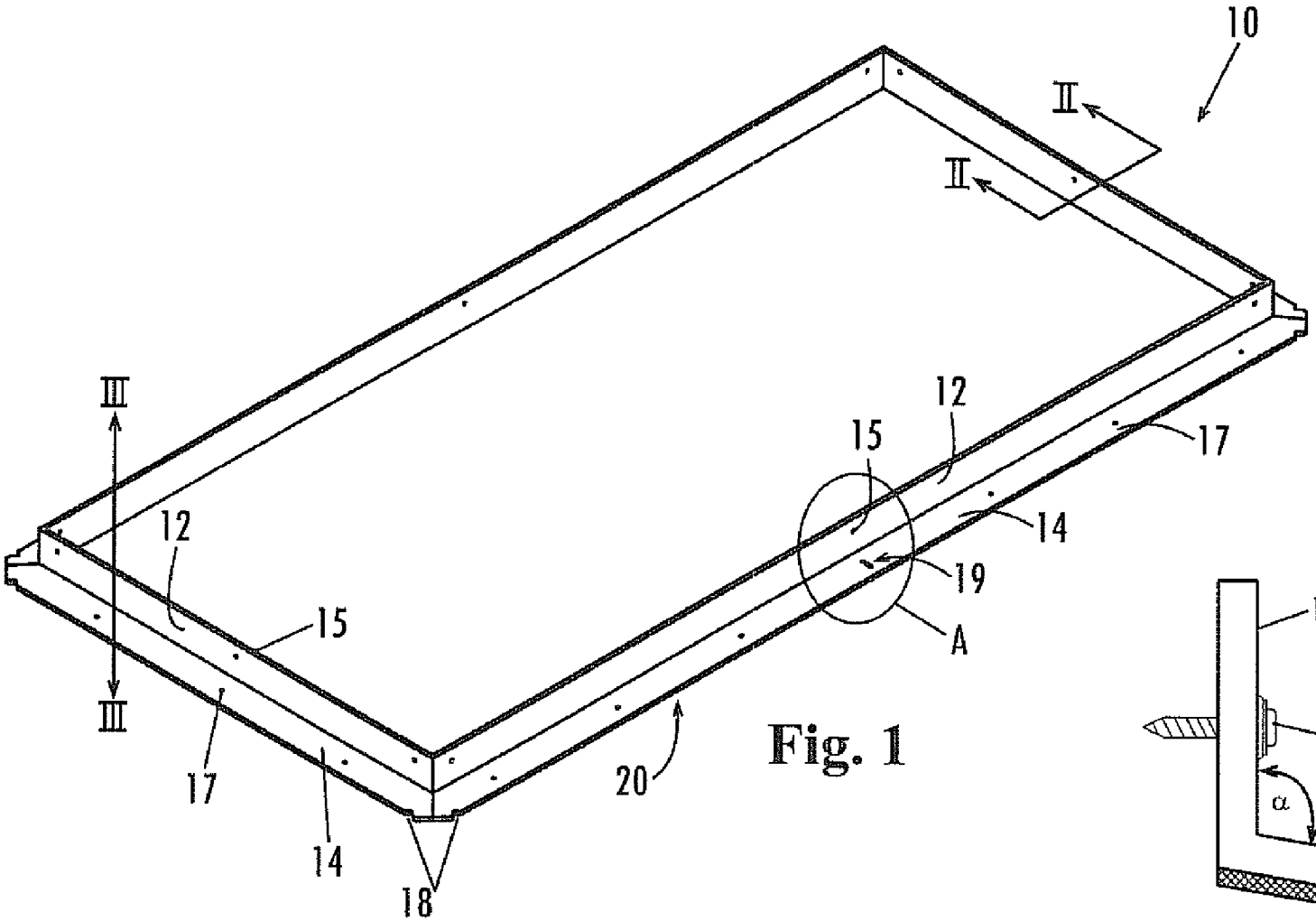
FIG. 1 is an isometric view of the deck-sealing surround of the present disclosure.
Figure 2:
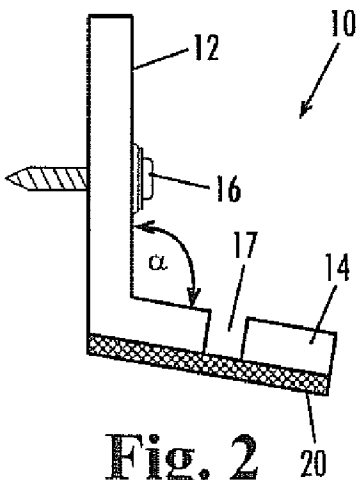
FIG. 2 is a cross-sectional view of the deck-sealing surround of FIG. 1, as taken along line II-II of FIG. 1.
Figure 5:
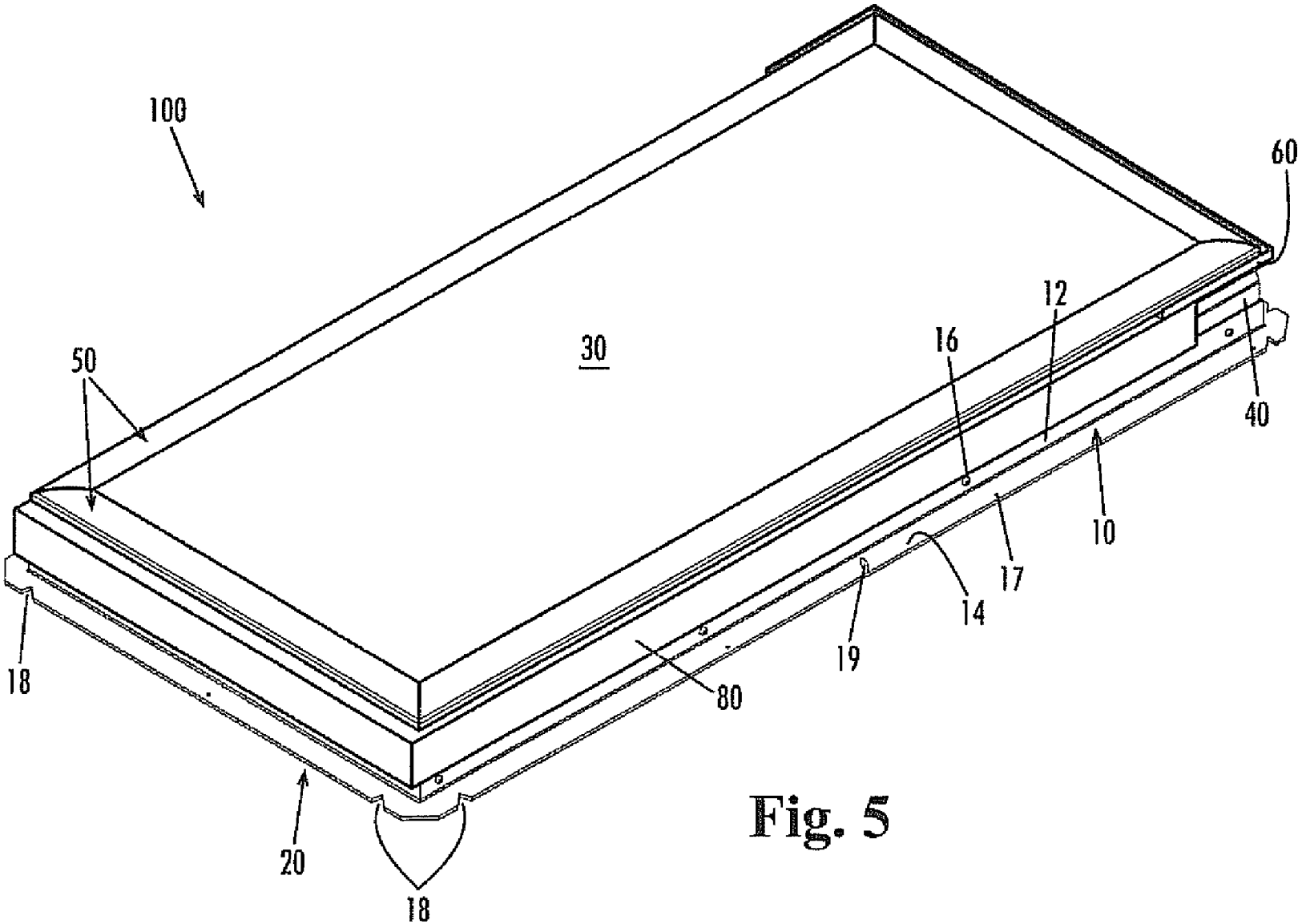
FIG. 5 is an isometric view of a deck-mounted skylight assembly, including the deck-sealing surround of FIG. 1.

FIG. 1 is an isometric view of the present deck-sealing surround, an embodiment of which is designated, in general, by the number 10. The deck-sealing surround 10 is in the form of a unitary, or seamless, member defining a rectangular perimeter. Each side of the rectangular perimeter has an essentially obtuse-angled profile having a vertically extending surface 12 and a downwardly sloping surface 14 projecting away from the skylight opening. Each vertically extending surface 12 is configured to abut a curb of the skylight assembly 100 (as shown in FIG. 5). Accordingly, the vertically extending surfaces 12 include a plurality of apertures 15 therethrough for receipt of a joining element (for example, screws 16, as shown in FIG. 2) for securing the deck-sealing surround 10 to the skylight assembly 100. The vertically extending surfaces 12 may define a height that is approximately half the height of the curb members to which the vertically extending surfaces 12 are attached, although the height of the vertically extending surfaces 12 may be higher or lower, as desired.

Similarly, the downwardly sloping surfaces 14 include a plurality of apertures 17 therethrough for receipt of a joining element (not shown) for securing the deck-sealing surround 10 (and thereby the skylight assembly) to a rooftop. The respective ends of the downwardly sloping surfaces 14 may include an inwardly projecting notch 18 (shown in FIG. 3) useful for aligning the skylight (100) over an opening in a building rooftop. The downwardly sloping surfaces 14 of the longitudinal sides of the deck-sealing surround 10 may further include—for example, in a centrally located area—one or more slot-shaped apertures 19 (shown in FIG. 4), which may be used to temporarily position the deck-sealing surround 10 during skylight installation. The underside of the downwardly sloping surfaces 14 (that is, the roof-abutting sides) may include a layer of barrier material 20, such as a closed cell foam.

FIG. 2 is a cross-sectional view of the deck-sealing surround 10, as taken along line II-II of FIG. 1, showing the obtuse-angled profile formed by the integral vertically extending surface 12 and the downwardly sloping surface 14. As shown, a joining element 16 may be positioned through each of a number of apertures (15, as shown in FIG. 1) in the vertically extending surface 12 to attach the deck-sealing surround 10 to the curb of the skylight assembly 100.

As mentioned briefly above, the vertically extending surfaces 12 and the downwardly sloping surfaces 14 define an obtuse angle $\alpha$ ("alpha") therebetween. It has been found that surrounds having profiles at a strict 90-degree angle (i.e., a right angle) are less effective at forming a watertight seal between the smooth, regularly contoured surround 10 and a potentially irregularly contoured, or uneven, roof surface. Thus, the obtuse angle $\alpha$ may be any angle in the range of greater than 90 degrees to about 100 degrees or, alternately, any angle in the range of about 95 degrees to about 100 degrees. Such obtuse angles have been discovered to be particularly useful in creating a desirable amount of tension between the deck-sealing surround 10 and the roof.

Specifically, during the installation of the skylight 100, the weight of the skylight 100 may press down on the sloping surfaces 14 of the deck-sealing surround 10. In addition, the installation of the joining elements 16, such as those in FIG. 2, through the sloping surfaces 14 tends to flatten the sloping surfaces 14 against the roof. As a result of these compressive forces, a majority of the sloping surfaces 14 of the deck-sealing surround 10 is drawn closer to the roof, thereby effectively causing the barrier material 20 to be forced into any gaps between the skylight (100) and the roof (for example, as may result from uneven, or irregular, roofing substrates).

Figure 3:
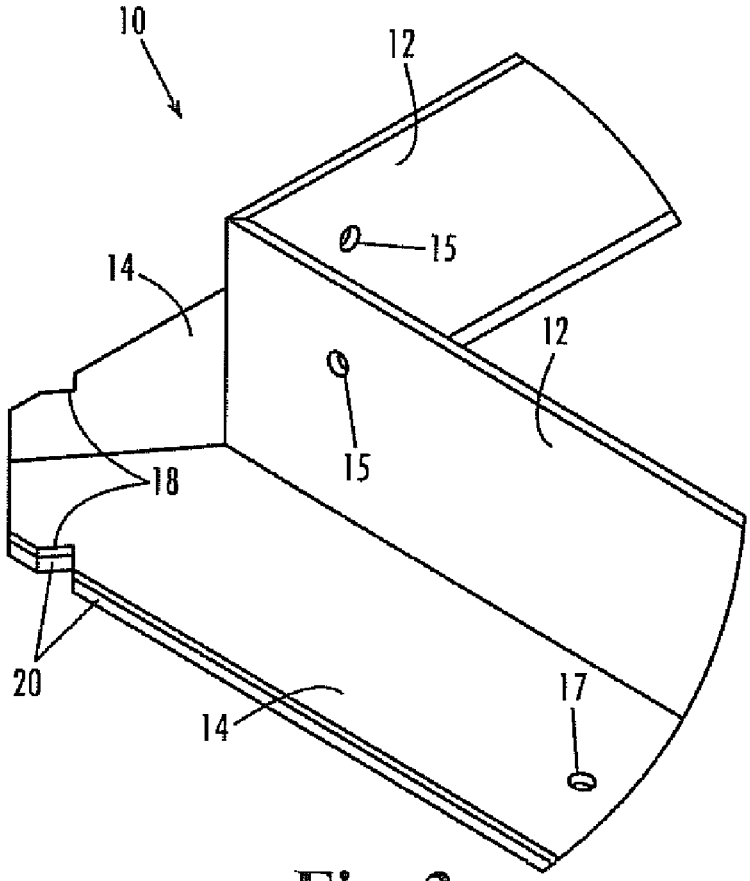
FIG. 3 is an isometric view of a corner of the deck-sealing surround of FIG. 1, as taken along line III-III of FIG. 1.

The downwardly sloping surface 14 includes a number of similar apertures 17, one of which may be seen in FIG. 3. Because the protective barrier material 20 affixed to the underside of the downwardly sloping surfaces 14 is sufficiently flexible, it is not required that the apertures 17 extend through the protective barrier material 20. Rather, by not pre-forming an opening in the barrier material 20, the barrier material 20 may be permitted to envelope the joining element 16 as the joining element 16 is inserted, thereby maintaining a watertight seal between the deck-sealing surround 10 and the skylight opening. The joining elements 16 (not shown in this view) positioned through the apertures 17 secure the skylight assembly 100 to the rooftop. Accordingly, the number of apertures 17 and their relative spacing may be based upon the size of the skylight, wind uplift considerations, and the like.

The phrase "joining element" may refer to any of screws, nails, staples, or other fasteners, which may be used to affix the deck-sealing surround 10 to the skylight curb and/or to the building roof. It should be understood that one type of joining element may be used to attach the vertically extending surfaces 12 to the skylight assembly, while another type of joining element may be used to attach the downwardly sloping surfaces 14 of the deck-sealing surround 10 to the rooftop. For instance, a skylight manufacturer (accustomed to adjoining parts with screws) may attach the deck-sealing surround 10 to the skylight assembly with screws positioned through the vertically extending surfaces 12, thus providing the deck-sealing surround 10 as a part of an installation-ready skylight assembly. However, when the skylight assembly may be installed, a roofer (accustomed to using nails) may choose to use nails as a means of securing the downwardly sloping surfaces 14 of the deck-sealing surround 10 to the building roof. Of course, the same type of joining element 16 may be used in all instances, if desired.

FIG. 3 also shows the barrier material 20, a thin layer of material attached to the lower side of the sloping surfaces 14 to prevent air and moisture transport beneath the skylight through the skylight opening. Representative materials for such purpose include polyurethane foam and thermoplastic elastomer (TPE), although other materials may instead be used. The barrier layer 20 may have a thickness of from about 3 millimeters (mm) to about 5 mm; however, other thicknesses may be used. The barrier material 20 may be adhered to the underside of the downwardly sloping surfaces 14 by a compatible adhesive compound or may be attached by any other suitable means or may be attached to the roof adjacent the skylight opening.

A corner of the deck-sealing surround 10 may be seen in FIG. 3. The vertically extending surfaces 12 are configured to abut respective curb members (40, as shown in FIG. 5) attached to the skylight assembly (100, as shown in FIG. 5). Appropriate joining elements (16, as shown in FIG. 5) may be inserted through the apertures 15 to secure the deck-sealing surround 10 to the skylight assembly (100) before the skylight assembly (100) is transported to an installation location on a rooftop. Alternately, the skylight (including the curb members, sash members, and covering element) may be transported to the installation location, where the deck-sealing surround 10 may be attached to the curb members and then to the roof.

Figure 4:
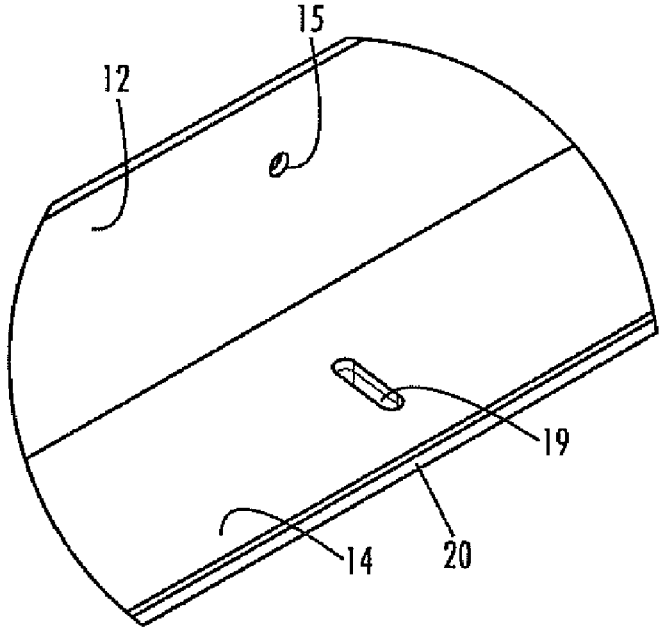
FIG. 4 is an enlarged isometric view of a portion of a longitudinal side of the deck-sealing surround of FIG. 1, as shown in Detail A of FIG. 1, which illustrates a slot-shaped aperture through such longitudinal side.

Referring now to FIG. 4, the present deck-sealing surround 10 may be advantageously employed in temporarily securing the skylight assembly 100 to the rooftop by inserting appropriate joining elements (16) through the slot-shaped apertures 19 to loosely secure the skylight assembly 100 while final adjustments are made. The slot-shaped apertures 19 are oriented in a direction parallel, or substantially parallel, to the transverse sides of the deck-sealing surround 10 (that is, the slot-shaped apertures 19 extend across the downwardly sloping surface 14). The slot-shaped apertures 19 may be located near the midpoint of the longitudinal sides of the deck-sealing surround 10 or may be located instead, or in addition, at other areas (e.g., the ends) of the longitudinal sides of the deck-sealing surround 10.

FIG. 5 is an isometric view of an assembled skylight 100 as it may be positioned on a building roof (not shown). The skylight assembly 100 includes a covering element 30, such as a dual-paned glass panel, which is surrounded and supported by a plurality of sash members 50. The covering element 30 and the sash members 50 are supported on a wooden frame 40 made of a plurality of curb members. A headpiece 60 may be attached to one end of the skylight assembly 100, as shown, that end functioning as the upper end of the skylight assembly 100, when installed.

As mentioned above, the skylight 100 may be initially secured to the roof by inserting joining elements (16) through the slot-shaped apertures 19 at the center of the longitudinal sides of the surround 10. Once the skylight 100 is centered satisfactorily over the opening, additional joining elements 16 may be inserted through the apertures 17 along the downwardly sloping surfaces 14 to permanently secure the skylight assembly 100 to the roof. As mentioned previously, the engagement of the joining elements 16 with the roof causes a majority of the downwardly sloping surfaces 14 to be brought into contact with the roof (that is, the angle $\alpha$ may approximate 90 degrees). As a result, the barrier material 20 affixed to the underside (or roof-abutting side) of the downwardly sloping surfaces 14 fully fills the void of any surface irregularities on the roof thus providing a desirable air and water barrier for the skylight assembly 100.

The deck-sealing surround 10 may be attached to the wood frame 40 before the skylight assembly 100 is transported to a building rooftop for installation. It has been observed that installers of skylights often mark the roofing surface to indicate the area for the skylight opening (e.g., by using a chalkline). These lines are useful not only for creating the skylight opening, but also for aligning the skylight within the opening. To facilitate the alignment of the skylight 100, the deck-sealing surround 10 may be provided with inwardly projecting notches 18 at each end of the downwardly projecting surfaces 14. Such notches 18 allow the installer to view the previously made marks without having to repeatedly lift the skylight 100, thus enabling adjustments to be easily made.

In many instances, it may be desirable to install a flashing element around the skylight assembly 100 once the deck-sealing surround 10 is secured to the rooftop. The flashing element may be positioned directly over the deck-sealing surround 10 and against the exposed edges of the curb members comprising the wood frame 40. Once the flashing has been installed, one or more cladding members 80 may be positioned around the skylight assembly 100 to further protect the assembly from the elements.

The preceding discussion merely illustrates the principles of the present deck-sealing surround 10. It will thus be appreciated that those skilled in the art will be able to devise various arrangements, which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the inventions and the concepts contributed by the inventor(s) to furthering the art and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawings, which are to be considered part of the entire description of the invention. In the description, relative terms such as "lower", "upper", "horizontal", "vertical", "above", "below", "up", "down", "top" and "bottom", as well as derivatives thereof (e.g., "horizontally", "downwardly", etc.) should be construed to refer to the orientation as then described or as shown in the drawing under discussion. These relative terms are for convenience of description and do not required that the apparatus be constructed or operated in a particular orientation, unless otherwise indicated. Terms concerning attachment, coupling, and the like, such as "connected", "attached", or "interconnected", refer to a relationship wherein structures are secured or attached to one another either directly or indirectly through intervening structures, as well as both movable or rigid attachments or relationships, unless expressly described otherwise.

The foregoing description provides a teaching of the subject matter of the appended claims, including the best mode known at the time of filing, but is in no way intended to preclude foreseeable variations contemplated by those of skill in the art.

We claim:

1. A unitary deck-sealing surround for a skylight assembly, the surround comprising:

a seamless member defining a rectangular perimeter about the skylight assembly, each side of the rectangular perimeter having an obtuse-angled profile, the obtuse-angled profile comprising a vertically extending surface and a downwardly sloping surface defining there between an obtuse angle having a measurement of between greater than 90 degrees and about 100 degrees, each vertically extending surface being configured to abut a curb member of the skylight assembly and defining a plurality of apertures there through for receipt of joining means for securing the vertically extending surface to the curb member, and each downwardly sloping surface being configured to abut a roof to which roof the skylight assembly is attached and defining a plurality of apertures there through for receipt of joining means for securing the downwardly sloping surface to the roof and further having a layer of barrier material adhered to the roof-abutting side thereof;

wherein the surround comprises a pair of longitudinal sides and a pair of transverse sides, the downwardly sloping surfaces of the longitudinal sides further defining a slot-shaped aperture positioned along at each end for temporary receipt of a joining means, each slot-shaped aperture extending in a direction parallel to the transverse sides.

2. The surround of claim 1, wherein the joining means is a screw.

3. A unitary deck-sealing surround for a skylight assembly, the surround comprising:

a seamless member defining a perimeter about the skylight assembly, perimeter having a profile formed of a curb-abutting surface and a roof-abutting surface, each curb-abutting surface being configured to abut a curb member of a skylight assembly and defining a plurality of apertures there through for receipt of joining means for securing the curb-abutting surface to the curb member, and each rooftop-abutting surface being configured to abut a roof and defining a plurality of apertures there through for receipt of joining means for securing the rooftop-abutting surface to the roof and further having a layer of barrier material adhered to a side of the rooftop-abutting surface for contact with a roof, wherein each end of each rooftop-abutting surface defines an inwardly projecting notch;

wherein the surround comprises a pair of longitudinal sides and a pair of transverse sides, the rooftop-abutting surfaces of each of the longitudinal sides further defining a slot-shaped aperture there through for receipt of a joining means, each slot-shaped aperture extending in a direction parallel to the transverse sides.

* * * * *